US009511503B2

(12) United States Patent
Baba et al.

(10) Patent No.: US 9,511,503 B2
(45) Date of Patent: Dec. 6, 2016

(54) TRIMMER APPARATUS

(71) Applicants: Kenji Baba, Kofu (JP); Chiaki Osada, Nirasaki (JP); Hirokazu Tanaka, Minami-Alps (JP)

(72) Inventors: Kenji Baba, Kofu (JP); Chiaki Osada, Nirasaki (JP); Hirokazu Tanaka, Minami-Alps (JP)

(73) Assignee: SEIKO LTD., Kawasaki-Shi, Kanagawa (JP)

( * ) Notice: Subject to any disclaimer, the term of this patent is extended or adjusted under 35 U.S.C. 154(b) by 54 days.

(21) Appl. No.: 14/575,380

(22) Filed: Dec. 18, 2014

(65) Prior Publication Data

US 2015/0174778 A1 Jun. 25, 2015

(30) Foreign Application Priority Data

Dec. 19, 2013 (JP) ..... 2013-262107
May 16, 2014 (JP) ..... 2014-102135

(51) Int. Cl.
*B26D 1/11* (2006.01)
*B26D 7/02* (2006.01)
(Continued)

(52) U.S. Cl.
CPC . *B26D 1/11* (2013.01); *B26D 1/06* (2013.01); *B26D 1/18* (2013.01); *B26D 7/015* (2013.01);
(Continued)

(58) Field of Classification Search
CPC ..... Y10T 83/7487; Y10T 83/7507; Y10T 83/7493; Y10T 83/2081; Y10T 83/2083; Y10T 83/2092; Y10T 83/2179; Y10T 83/2209; Y10T 83/2211; Y10T 83/2213; Y10T 83/2216; Y10T 83/2218; Y10T 83/494; Y10T 83/5669; Y10T 83/647; Y10T 83/687; Y10T 83/8821; Y10T 83/8822; B41J 11/70;B41J 11/706; B26D 7/025; B26D 7/01; B26D 7/015; B26D 7/02; B26D 7/0675; B26D 7/06; B26D 7/18; B26D 7/32; B26D 1/02; B26D 1/025; B26D 1/03; B26D 1/04; B26D 1/06; B26D 1/065; B26D 1/10; B26D 1/105; B26D 1/11; B26D 1/14; B26D 1/20; B26D 1/25; B26D 5/06; B26D 2007/0018; B26D 2007/0043; B26D 2007/0068; B26D 2007/322; B26D 2011/0053; B26D 2011/0033
See application file for complete search history.

(56) References Cited

U.S. PATENT DOCUMENTS 1,876,075 A * 9/1932 Reichert, Jr. ..... B26D 1/0006 30/240
5,881,623 A * 3/1999 Otani ..... B26D 1/245 83/455
(Continued)

FOREIGN PATENT DOCUMENTS

JP 2006-198739 A 8/2006
JP 3838721 B2 10/2006
(Continued)

*Primary Examiner* — Phong Nguyen
(74) *Attorney, Agent, or Firm* — Manabu Kanesaka

(57) ABSTRACT

A trimming apparatus, which carries out trimming with cutter blades running from one end of a material to be cut to the other end thereof, includes an apparatus frame, a bed surface having a bed plate for the material to be cut, a first and a second guide plates disposed in parallel above and under and holding the bed surface therebetween, a first holder member slidably supported by the first guide member and holding the first cutter blade, a second holder member slidably supported by the second guide member and holding the second cutter blade, a connector which connects one of the second cutter blade and the second holder member to the first cutter blade, and a drive device which makes at least one of the first holder member and the second holder member run from one end of the material to be cut to the other end.

7 Claims, 11 Drawing Sheets

(51) Int. Cl.

| | |
|---|---|
| ***B26D 7/01*** | (2006.01) |
| ***B26D 1/06*** | (2006.01) |
| ***B26D 1/18*** | (2006.01) |
| *B26D 1/00* | (2006.01) |

(52) U.S. Cl.
CPC ..... *B26D 7/025* (2013.01); *B26D 2001/0066* (2013.01); *Y10T 83/7487* (2015.04)

(56) References Cited

U.S. PATENT DOCUMENTS

| | | | | |
|---|---|---|---|---|
| 6,832,537 | B2 * | 12/2004 | Takabatake ..... | B26D 1/0006 83/508 |
| 8,500,350 | B2 * | 8/2013 | Kumai ..... | B26D 1/245 400/619 |
| 2006/0162524 | A1 | 7/2006 | Suzuki et al. | |

FOREIGN PATENT DOCUMENTS

| | | | |
|---|---|---|---|
| JP | 2008-142816 | A | 6/2008 |
| JP | 4814773 | B2 | 11/2011 |
| JP | 4824613 | B2 | 11/2011 |
| JP | 4881707 | B2 | 2/2012 |
| JP | 5006006 | B2 | 8/2012 |
| JP | 2012-183602 | A | 9/2012 |
| JP | 5063144 | B2 | 10/2012 |

* cited by examiner

TRIMMER APPARATUS

RELATED APPLICATIONS

The present application is based on, and claims priority from, Japanese Application No. 2013-262107 filed Dec. 19, 2013 and No. 2014-102135 filed May 16, 2014, the disclosure of which is hereby incorporated by reference herein in its entirety.

BACKGROUND OF THE INVENTION AND RELATED ART STATEMENT

Field of the Invention

The present invention relates to a trimmer apparatus for cutting materials to be cut such as a sheet bundle, and is in particular concerned with an improvement of a cutting mechanism of small size, light weight and rich in cutting quality.

Description of the Prior Art

This kind of trimmer apparatuses have been known from such a guillotine system cutting mechanism of cutting a sheet bundle placed on a bed plate with a flat shaped guillotine cutter, a disk system cutting mechanism of cutting the sheet bundle gradually from its one end toward the other end while rotating a disc shaped rotating edge, or a travel cutting mechanism of traveling a flat shaped cutter from one end toward the other end of a material to be cut for gradually cutting.

The guillotine system cutting mechanism has been known as a mechanism of setting the material to be cut as the sheet bundle on the bed plate and cutting it with a guillotine cutting blade going down from an upper place to a lower place. This system is known from, for example, Japan patents No. 4814773, No. 4824613, No. 4881707, No. 5006006 or No. 5063144.

Further, the disk system cutting mechanism has been known as holding under pressure the material to be cut on a bed plate, and traveling the rotating edge from one end of this material to the other end while rotating the rotating cutter blade. This system is disclosed in, for example, Japan patent laid-open No. 2008-142816, No. 2012-183602 (Ogawa), Patents No. No. 4814773 or No. 3838721 (Furuyama).

In particular, Ogawa Patent and Furuyama Patent disclose such mechanisms of cutting the sheet bundle on the bed plate by such actuations of rotating an upper first rotary cutter blade and lower second rotary cutter blade while moving from its one end to the other end.

Further, the travel cutting mechanism is known as a cutting mechanism with flat-plate cutter blades of moving the material to be cut on the bed plate from one end to the other, for example, in Japan patent laid-open No. 2008-100297.

OBJECT OF THE INVENTION

The present invention has a subject of providing a trimmer apparatus which is comparatively small in cutting load and enables smooth cutting and miniaturization for cutting a material to be cut on the bed plate with a cutter blade running from its one end to the other end.

SUMMARY OF THE INVENTION

The invention attaches holder members slidably to the respective first and second guide materials parallel in upper and lower places holding the bed plate of the material to be cut therebetween, and combines a first cutter blade held to a first holder member and to a second cutter blade or a second holder member.

Further, the invention is characterized by moving at least one of the first and second guide members from one end to the other end of the material to be cut by means of a driving means.

DETAILED DESCRIPTION OF PREFERRED EMBODIMENT

Explanation will be made in detail based on an under shown preferred embodiments.

Figure 1:
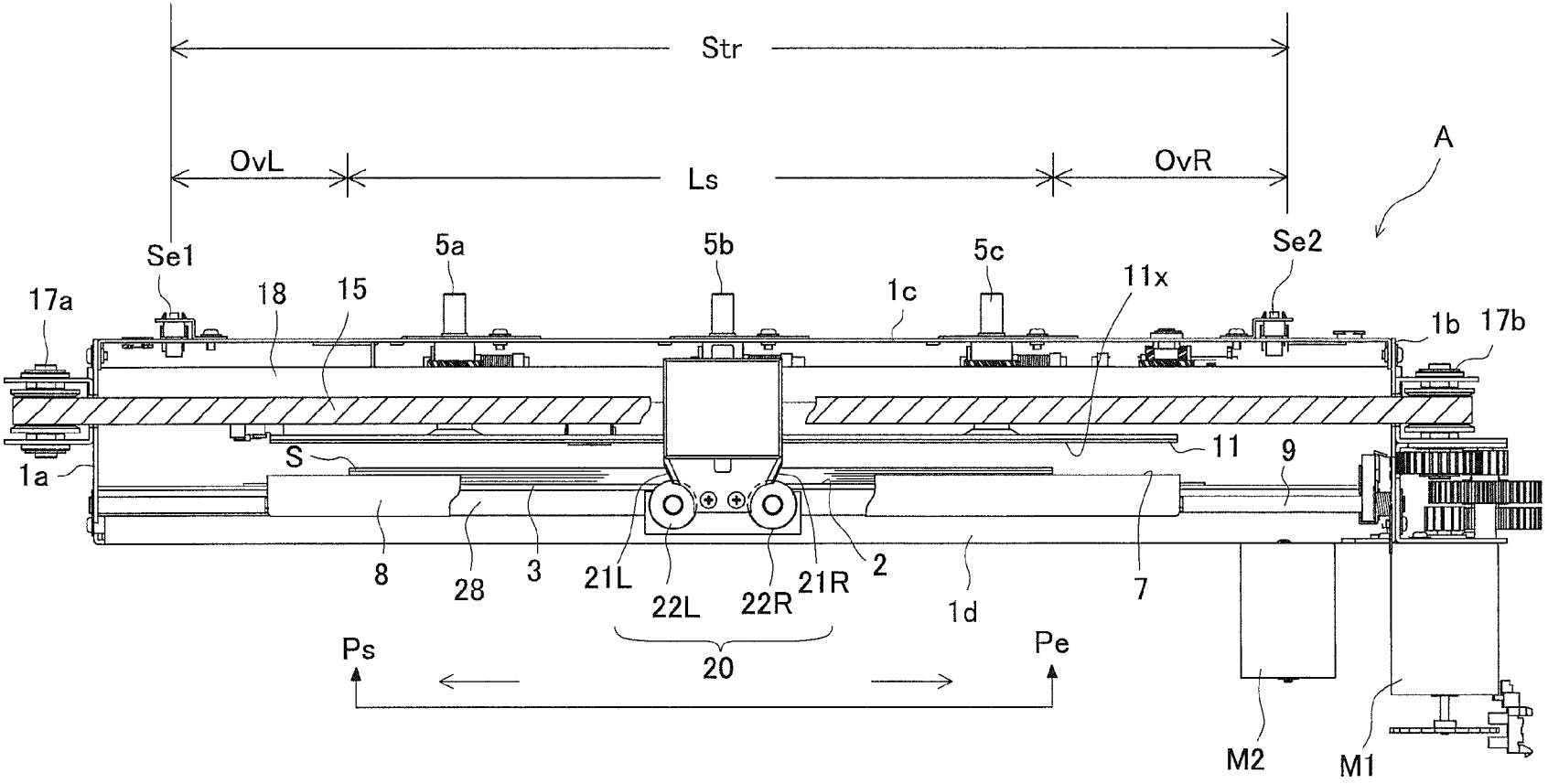
FIG. 1 is an explanatory view of a whole structure of the trimmer apparatus in dependence on the invention.
Figure 2:
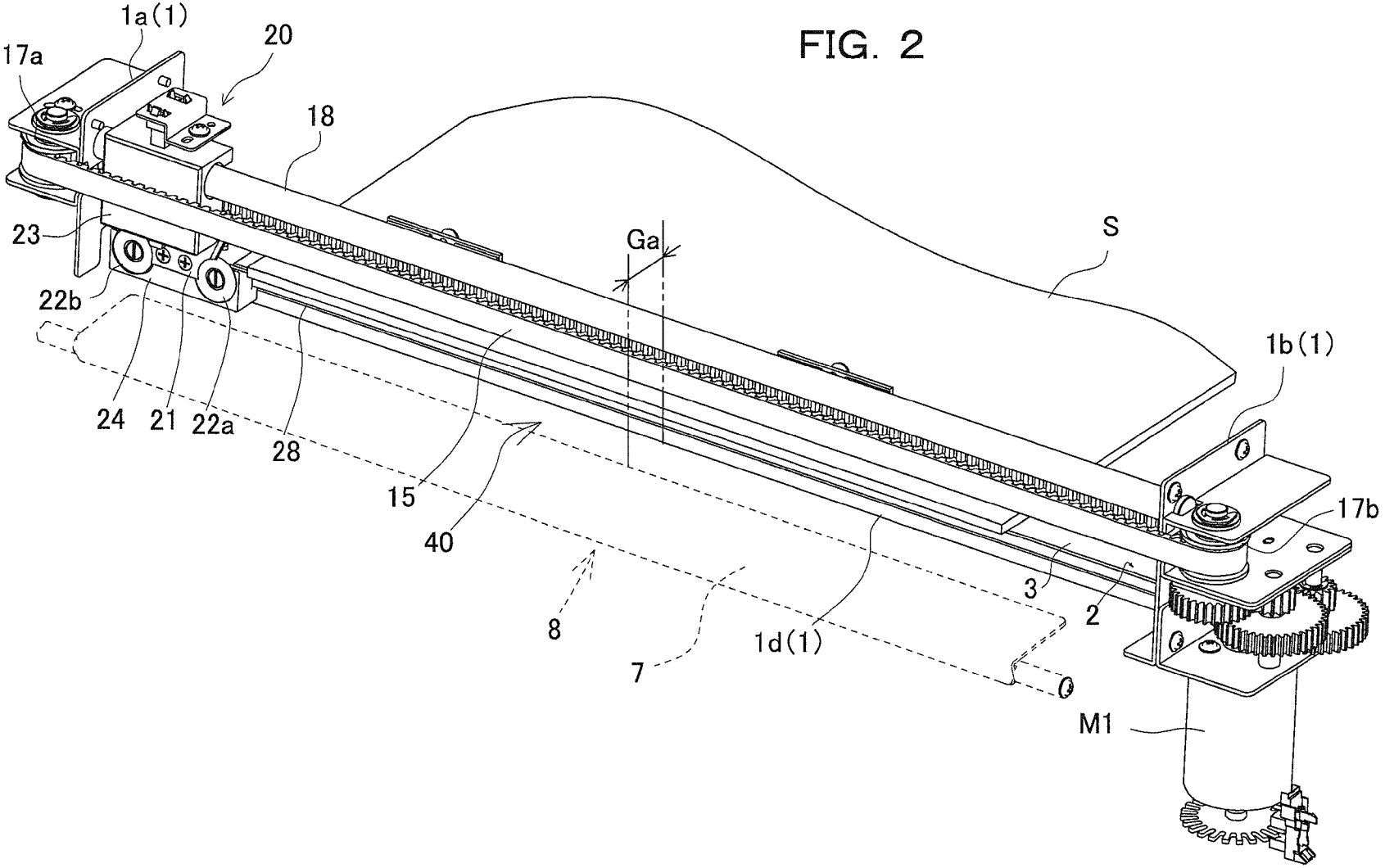
FIG. 2 is a perspective and explanatory view of the cutting mechanism of cutting the sheet bundle in the apparatus of FIG. 1.
Figure 3:
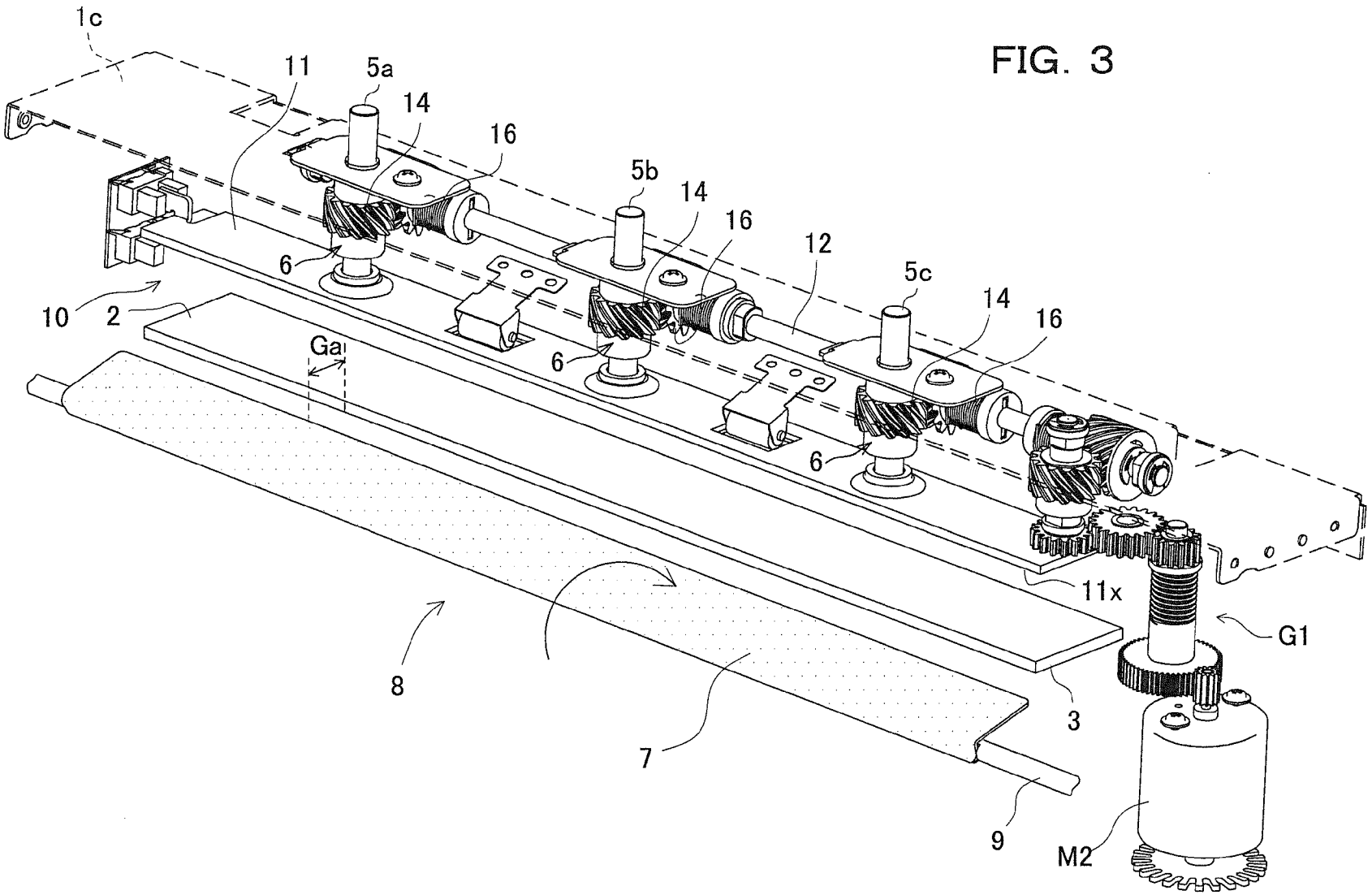
FIG. 3 is a perspective and explanatory view of the sheet pressure mechanism in the apparatus of FIG. 1.

FIG. 1 shows the whole structure of the trimmer apparatus A, FIG. 2 shows a drive mechanism of reciprocating the cutter unit 20 at a predetermined stroke Str, and FIG. 3 shows a press mechanism of holding the material S to be cut at the cutting position.

The illustrated apparatus is composed of an apparatus frame 1, a bed surface 2 of supporting a material S to be cut (referred to as "sheet bundle" hereafter), a carrier guide 8 of guiding the sheet bundle S (paper guide) having been sent from an upstream side onto the bed surface 2, a press mechanism 10 of pressing and holding the sheet bundle S onto the bed surface 2, a cutter unit 20 having cutter blades 21, 22, holder members 23, 24 of supporting the respective cutter blades, and a drive means 40 of reciprocating the holder members at a predetermined stroke Str. At the upstream side of the carrier guide 8, a carrier roller 41 is positioned.

The above mentioned carrier guide 8 carries the sheet bundle S with the carrier roll 41 at the upstream side onto the bed surface 2. The press means 10 presses and holds the position of the sheet bundle on the bed surface 2. The cutter unit 20 runs from one end Ps to another end Pe of the sheet bundle on the bed surface, and cuts the sheet bundle during this running.

After cutting the sheet bundle, the carrier guide 8 is retreated to a place not disturbing cut pieces from dropping into a dust box (not shown).

The above mentioned apparatus frame 1 is, as shown in FIG. 1, composed of a pair of left and right side frames 1*a*, 1*b*, an upper base frame 1*c* connecting these both frames and a lower base frame 1*d*.

The bed plate 3 having the bed surface 2 is furnished onto the apparatus frame 1. The apparatus of FIG. 1 attaches a plate shaped bed 3 with respect to a pair of left and right side frames 1*a*, 1*b*, and forms the bed surface 2 on its upper surface.

The carrier guide 8 is disposed to an upstream side in carrying direction of the material to be cut (sheet bundle) toward the bed surface 2, and has a guide face 7 positioning with a running gap Ga in relation with the bed surface 3. The carrier guide 8 in FIG. 3 is formed with a plate member having a guide face 7, and is pivoted by a pivot 9 turnably between side frames 1*a*, 1*b*.

According to FIG. 1, explanation will be made to the structure of the bed plate 3 supporting the material S to be cut (sheet or others "b"). The bed surface 2 is formed to be longer than a length Ls (maximum cutting length) in a cutting direction of the sheet to be cut of a maximum size. A running stroke Str of the cutter unit 20 is set to be longer than the maximum cutting length Ls.

Shown OvR and OvL show overrun-lengths (distances) after the cutter unit 20 has cut the sheet bundle S.

"OvR" shows the overrun moving amount when moving (in an outward direction) the cutter unit 20 from a left end Ps of FIG. 1 to a right end Pe.

"OvL" shows the overrun moving amount when moving (in an inward direction) the cutter unit 20 from the right end Pe to the left end Ps.

The running stroke Str of the cutter unit 20 is determined in a relation of an under formula from the maximum cutting length Ls and the overrun lengths (OvR and OvL).

$$Str=(Ls+OvR+OvL) \quad \text{(Formula 1)}$$

In this case, the moving stroke Str of the cutter unit 20 shows the moving distance of cutting the material S to be cut (sheet bundle) preceding in moving in the outward direction and the moving distance of cutting the material S to be cut (sheet bundle) succeeding in moving in the inward direction.

Accordingly, when cutting the material S to be cut (sheet bundle) by moving only in one direction of the cutter unit 20, the running stroke Str is set in the relation of a following formula.

$$Str=(Ls+OvR) \quad \text{(Formula 2)}$$

The above mentioned press mechanism 10 will be explained in accordance with FIG. 3. In the apparatus frame 1 (upper base frame 1*c*), plural support rods 5 (5*a*, 5*b*, 5*c*) are supported, and at these front ends (lower ends in the drawing), a pressure plate 11 is secured.

In the apparatus frame 1, members 6 are rotatably attached, and these members 6 are mounted thereon with support rods 5 via screws. Each of the members 6 is integrally attached with each of passive side screws 14, and is geared with a drive side screw 16.

The drive side screw 16 is mounted on a rotational shaft 12 rotatably attached to the apparatus frame 1. The rotational shaft 12 is connected to a press motor M2 via a reduction gear G1.

With such a structure, the rotational shaft 12 rotates in a normal direction by rotation of the press motor M2. By this rotation, the drive side screw 16 rotates the passive side screws 14, and moves down each of the support rods 5 in a lower direction.

By rotation of the press motor M2 in an opposite direction, each of support rods 5 moves in an upward direction. By up and down actuations of the support rod 5, a pressure face 11*x* of the pressure plate 11 presses to hold the sheet bundle S against the bed surface 2, or releases pressurization.

[Cutter Unit]

Explanation will be made to the cutter unit 20. FIG. 5 shows the whole structure of the cutter unit 20, setting-up and dismantled perspective views, and FIGS. 6A and 6B are the explanatory views of the elementary part.

Figure 5A:
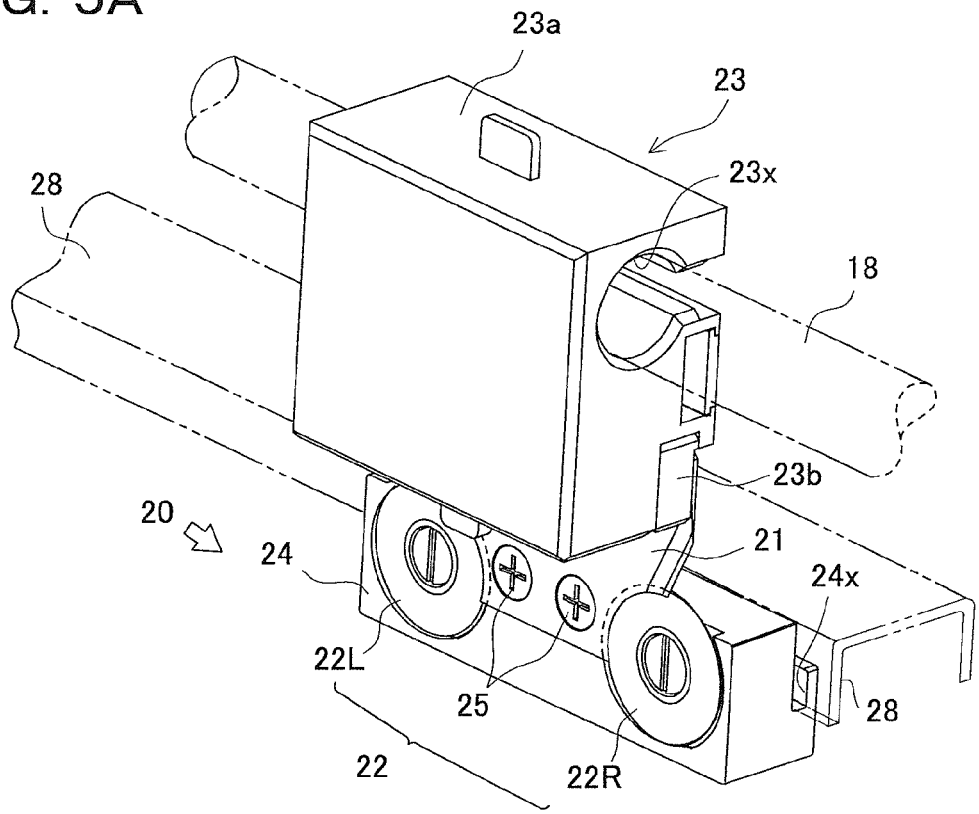
FIGS. 5A, 5B, and 5C are explanatory views of a cutter unit, where 5A is a perspective view showing the whole structure of the cutter unit, 5B is a dismantled and setting up of the cutter unit, and 5C is a central and vertical view of A.
Figure 5B:
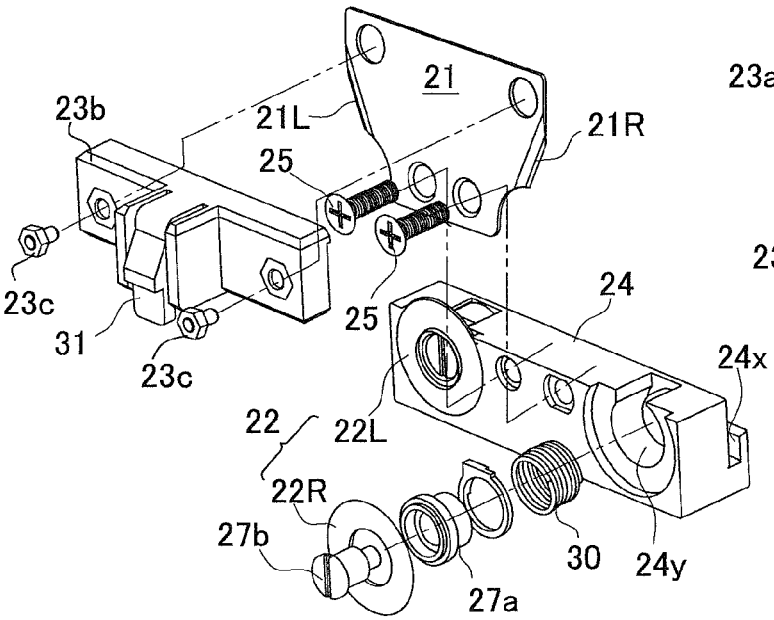
Figure 5C:
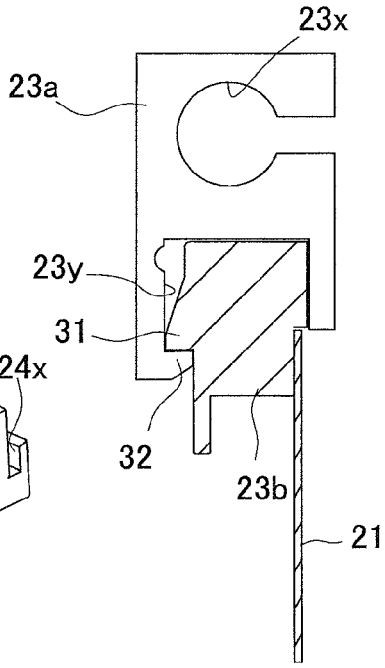
Figure 6A:
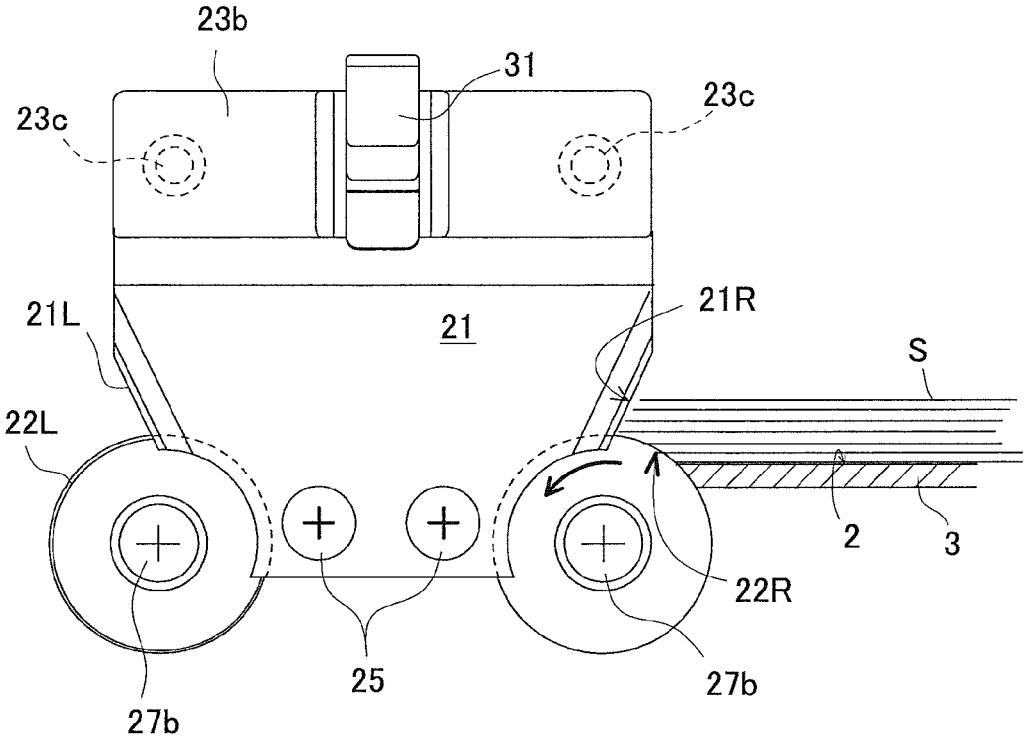
FIGS. 6A and 6B are explanatory views of the cutter unit in the apparatus of FIG. 1, where 6A shows a condition of cutting the sheet (sheet bundle to be cut), and 6B is an explanatory view of the cutting mechanisms thereof.
Figure 6B:
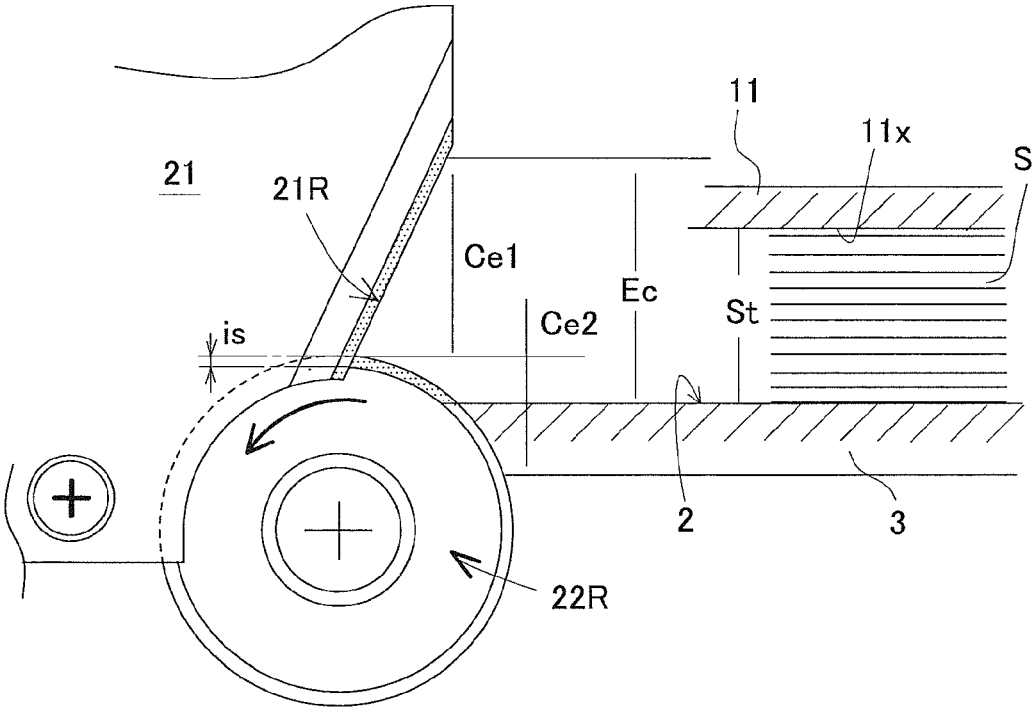

The cutter unit 20 in FIGS. 5A, 5B, and 5C shows the cases of cutting the materials to be cut (sheet bundle) by each action of moving the unit in the outward and inward directions. Therefore, the cutter blades (21, 22) to be explained under have cutting edges (21R, 22R) running in the outward direction and cutting edges (21L, 22L) running in the inward direction.

Accordingly, when the cutter unit 20 is an apparatus structure of cutting the material to be cut by any one of moving in the outward direction or in the inward direction, the cutting edge has only any one of moving directions (21R, 22R) or (21L, 22L).

In FIGS. 5A, 5B, and 5C, the cutter unit 20 is structured with the first cutter blade 21 and the second cutter blade 22, and a first holder member 23 and a second holder member 24 securing these first and second cutter blades.

The first cutter blade 21 is attached to the first holder member 23, and has the cutting edges 21R and 21L for cutting the material S to be cut.

The first holder member 23 is slidably mounted on a later mentioned first running guide member 18. The second cutter blade 22 is attached to the second holder member 24, and has a cutter blade 22R and a cutter blade 22L. The second holder member 24 is slidably mounted on a later mentioned second guide member 28.

One of the above mentioned second cutter blade 22 and second holder member 24 is integrally fixed to the cutter blade 21. A shown one is a connector 25 (fixing screw, welding, rivet or concave-convex connection), and the second holder member 24 is connected to the first cutter blade 21.

As to others, though not shown, it is sufficient that the first cutter blade 21 is directly attached with the second cutter blade 22 via the fixing screw 25 (fixedly or rotatably).

In reference to FIG. 4, explanation will be made to a guide mechanism slidably supporting the holder members 23, 24. The apparatus frame 1 is vertically provided with a first running guide member 18 and a second running guide member 28 holding the bed surface 2 therebetween.

The first running guide member 18 is composed of a guide rod furnished between side frames 1*a*, 1*b* above the bed surface 2. The second running guide member 28 is composed of a guide rail furnished on the bed surface 3 under the bed surface 2.

The first and second running guide members 18, 28 are parallel each other, and disposed along pre-set cutting lines (not shown) running from one end to the other of the sheet bundle on the bed surface 2.

The illustrated first running guide member 18 is composed of a rod material circle in cross section, while the second running member 28 is composed of a rail material in channel form.

The rod and channel forms in cross section of the first and second running guide members 18, 28 are not specified in shapes as circle, rectangular, L- or U-shapes, but may be determined as arbitrarily.

Figure 4:
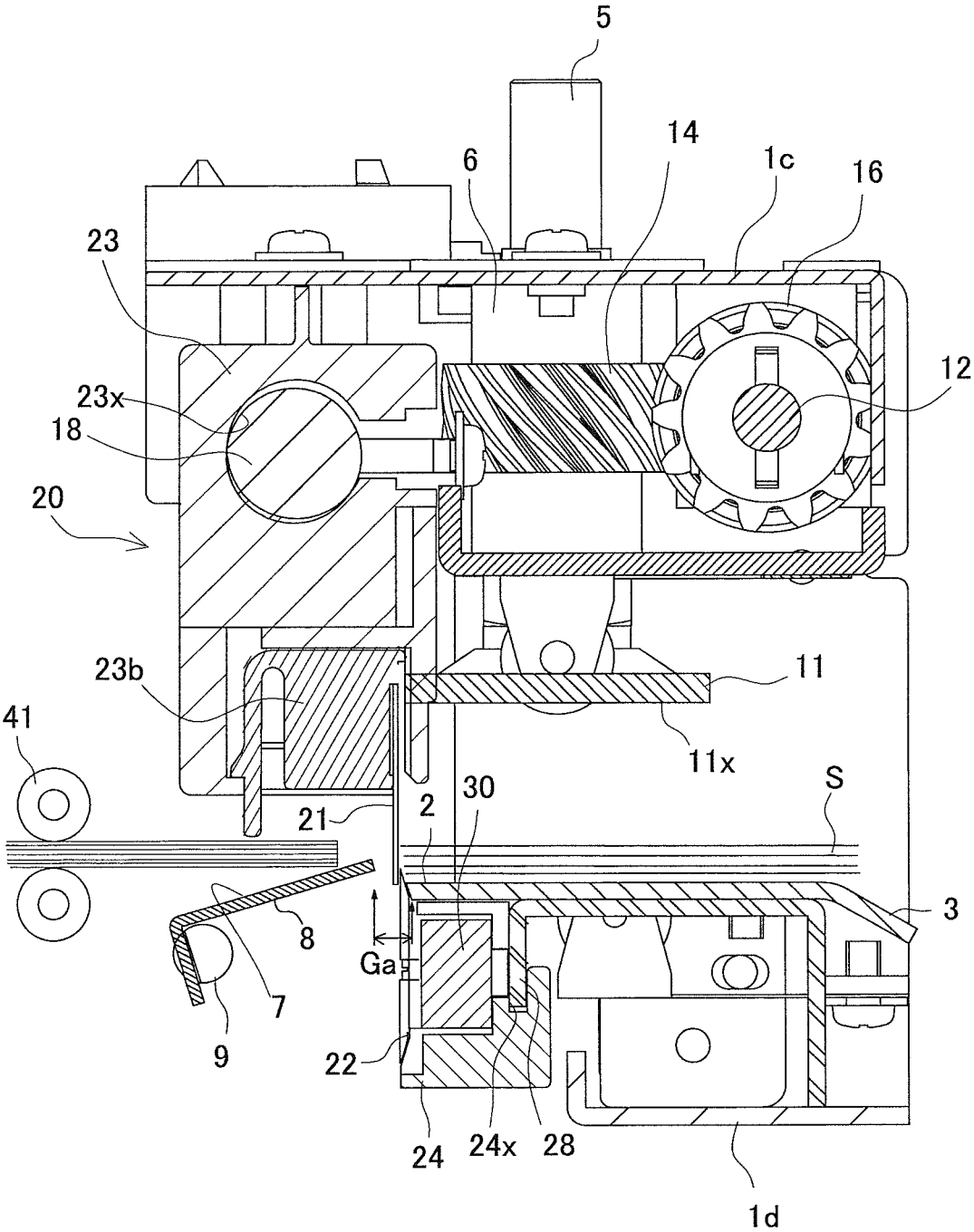
FIG. 4 is a centrally vertical cross sectional view of the apparatus of FIG. 1.

As shown in FIG. 4, the first holder member 23 is fitted in the first running guide member 18 of a rod shape in a fitting hole 23*x*, and is supported slidably in an axial direction.

In the second holder member 24, the fitting groove 24*x* is engaged in the second running guide member 28 and supported slidably in an axial direction.

Following FIGS. 5A, 5B, and 5C, the cutter unit will be explained in regard to a concrete structure. The cutter unit 20 is composed of one set of a first cutter blade 21 and two sets of second cutter blades 22 (22R, 22L). For cutting an upper half part of the sheet bundle S with the cutting edge 21R of the first cutter blade 21, while for cutting a lower half part thereof with the cutting edge 22R of the second cutting blade 22, the first cutter blade 21 and the second cutter blade 22 are formed with such cutting edges continuing in the depth direction (Ec-direction of FIG. 6B) of the material S to be cut (sheet bundle).

The continuing parts of both cutting edges overlap at a crossing point (is) (refer to FIG. 6B), so that a Ce 1-part of the cutting edge 21R of the first cutter blade 21 and a Ce 2 part of the cutting edge 22R of the second cutter blade 22 form an Enable cutting edge Ec.

The relation of the first cutter blade 21 and the second cutter blade 22 is shown in FIG. 6B. In regard to the Enable cutter blade Ce 1 of the first cutter blade 21 and the Enable cutter blade Ce 2 of the second cutter blade 22, their total length (Ec) is formed to be longer than a maximum cutting depth (St: allowable maximum thickness). The cutting length Ce 1 of the first cutter blade 21 is determined to be longer than the cutting length Ce-2 of the second cutter blade 22 (Refer to the under formulae).

$$Ce1+Ce2=Ec \quad \text{(Formula 3)}$$

$$Ce1+Ce2\geq St \quad \text{(Formula 4)}$$

$$Ce1>Ce2>0 \quad \text{(Formula 5)}$$

Ce 1: Enable cutter blade of the first cutter blade 21

Ce 2: Enable cutter blade of the second cutter blade 22

St: Maximum cutting depth

Further, the cutting edge 21R of the first cutter blade 21 is formed with an edge of a linear shape, while the cutting edge 22R of the second cutter blade 22 is formed with an edge of an arc shape. As later mentioned, the second cutting edge 22R is so pivoted as to rotate in an arrow direction (refer to FIG. 6B) with respect to the first cutter blade 21.

The first cutter blade 21 is formed with the cutting edge 21R for cutting the material S to be cut (sheet bundle) when the cutter unit 20 moves in the outward direction (right direction in FIGS. 6A and 6B) along the first and second guide members 18, 28 and, similarly, this is formed with the cutting edge 21L when the cutter unit 20 moves in the inward direction (left direction in FIGS. 6A and 6B).

The illustrated first cutter blade 21 is formed with a flat-shaped blade, and its right end is formed with the cutting edge 21R in the outward direction, while its left end is formed with the cutting edge 21L in the inward direction.

The first holder member 23 is composed of a slide part 23*a* and a cutting edge securing part 23*b*. The slide part 23*a* is formed with a fitting hole 23*x* to be slidably fitted on the first running guide member 18.

To a cutting edge fixing portion 23*b*, the first cutter blade 21 is fixed with the securing screws 23*c*. The first holder member 23 is mold-formed with a synthetic resin. The first cutter blade 21 is formed with a metal material such as a carbon steel or an alloy steel.

The second cutter blade 22 is composed with the separated two rotating edges of the cutting edge 22R for moving the cutter unit 20 in the outward direction as well as the cutting edge 22L for moving the cutter unit 20 in the inward direction.

The second holder member 24 is formed with a bearing hole 24*y* for pivoting rotatably the first and second rotating blades 22R, 22L, and in this bearing hole 24*y*, an elastic spring 30, a rotating sleeve 27*a* and a fixing pin (screw) 27*b* are rotatably attached.

As having mentioned above, the first holder member 23 is fixed with the first cutter blade 21 at a securing part 23*b* of the cutting edge, and this first cutter blade 21 is secured to a second holder 24 with a connector 25 (such as screw, welding, rivet or concave-convex fitting). Thus, the second holder 24 is rotatably pivoted with a second cutter blade 22 (shown are rotating edges 21R, 212L).

By the way, the elastic spring 30 presses the cutting edge of the second cutter blade 22 to the cutting edge of the second cutter blade 21.

In the embodiment of FIG. 1, the cutting edges (21R, 21L) of the first cutter blade 21 and the cutting edges (22R, 22L) of the second cutter blade 22 are placed respectively in the left and right running directions of the cutter unit 20. This is because when moving the cutter unit 20 in the left and right directions, the sheet bundle S is cut in the respective directions. Accordingly, when the cutter unit 20 is structured to cut only in one direction, it is sufficient to place the cutting edges of the first and second cutter blades in one direction (outward or inward direction).

By the way, in the illustrated apparatus, when supporting the cutter blades 21, 22 to the apparatus, the metal screws 25 fix them to the second holder member 24. Then, the second holder member 24 is structured to make conductive to the guide rail 28 (electrically conductive metal) in the side of the apparatus frame.

Accordingly, static electricity occurring in the first, second cutter blades 21, 22 is earthed from the metal-made screw 25 to the guide rail 28.

As having mentioned above, the first holder member 23 and the first cutter blade 21 as well as the second holder member 24 and the second cutter blade 22 are integrally connected. Therefore, when any one of the first holder member and the second holder member is moved along the first and second running guide members 18, 28, the first and the second cutter blades 21, 22 integrally move from one end Ps of the material S to be cut to the other end Pe, and perform cutting.

[Explanation of the Driving Means]

Further explanation will be made to the drive means 40 which moves any one of the first and second holder members 23, 24 from one end of the material S (sheet bundle) to be cut on the bed surface 2 to the other end.

The drive means 40 shown in FIG. 2 is structured with a drive motor M1 and a linear running mechanism reciprocating between one end of the material S (sheet bundle) on the bed surface 2 and its other end.

The apparatus frame 1 is disposed with a drive motor M1 and a pair of pulleys 17*a*, 17*b*, and a timing belt 15 is bridged between the pulleys.

The timing belt 15 is disposed in parallel to the first, second running guide members 18, 28, and one part of the belt is secured to the first holder member 23.

The drive motor M1 is composed of a reverse-inverse motor, and its output rotation shaft is connected to a pulley 17*b* via a reduction mechanism (shown is a gear reduction mechanism).

Accordingly, a linear running mechanism is composed of a pair of pulleys 17*a*, 17*b* and a timing belt 15 bridged thereon. It is also possible to compose the linear running mechanism with a wire and pulley (winding roll) instead of this timing belt 15.

The above mentioned linear running mechanism slidably disposes a rack (not shown) on the apparatus frame 1, and connects a first holder member 23 (otherwise, a second holder member 24) on this rack.

A pinion (not shown) gearing with the above rack is secured on the apparatus frame 1 to transmit rotation of the drive motor M1 to the pinion.

It is thereby possible to reciprocate the holder member 23 (or 24) by rotation of the drive motor M1 at a predetermined stroke (Str).

The apparatus frame 1 is arranged with a lead screw in parallel with the first running guide member 18, and the lead screw is rotatably bearing-supported to the apparatus frame 1.

A fitting portion (not shown) shaped in nut and fitted in a lead screw is connected to a first holder member 23. The lead screw is reciprocally rotated by the drive motor M1.

Thereby, the first holder member 23 reciprocates at a determined stroke by rotation of the lead screw.

Figure 7:
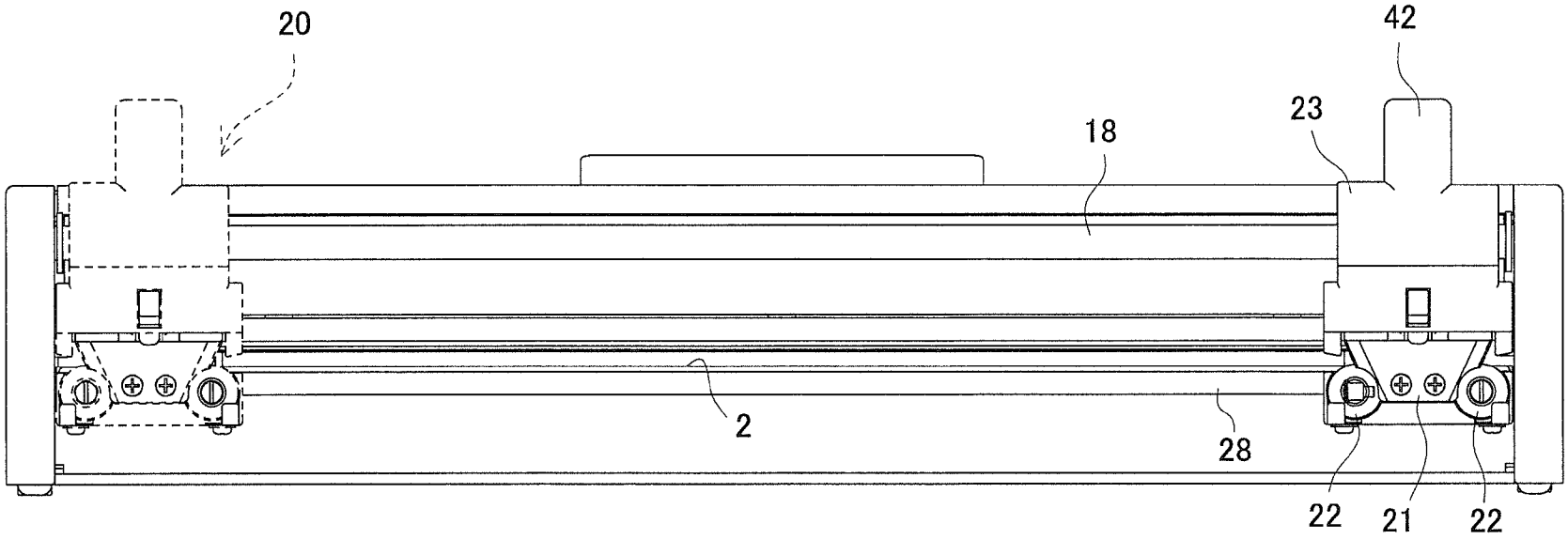
FIG. 7 is a practical embodiment of a driving mechanism being different from the apparatus of FIG. 1.

An apparatus shown in FIG. 7 is provided with a manually operable knob 42 on a first holder member 23, and when an operator moves the knob 42 with fingers, the first holder member 23 is moved from one end of the sheet bundle S to the other end.

The first holder 23 is attached with the first cutter blade 21 which is connected with the second cutter blade 22 and the second holder member 24. The first holder member 23 is slidably fitted on the running guide member 18, and the second holder member 24 is slidably engaged with the second running guide member 28.

[Attaching and Detaching of the Cutter Unit]

The cuter unit 20 having been explained in FIGS. 5A, 5B, and 5C must exchanges a new cutting edge for an old one in response to wearing of the cutting edge, and its structure will be explained.

The above mentioned first holder member 23 is divided into two parts of a slider part 23*a* and a cutting edge securing part 23*b* (see FIGS. 5A, 5B, and 5C and FIGS. 10A and 10B). The slider portion 23*a* is, as above mentioned, formed with a fitting hole 23*x* and fitted on the first running guide member 18.

At a cutting edge securing part (exchanging part) 23*b*, as mentioned above, the first cutter blade 21 is fixed with a fixing screw 23*c*, and is made integral. Further, the first cutter blade 21 is fixed to the second holder member 24 by the securing screws (connector) 25. At the same time, the second holder member 24 is slidably engaged with the second running guide member 28.

At a slider part 23*a*, a connecting portion 23*y* is provided for connecting a cutting edge securing portion 23*b*. The shown connecting portion 23*y* is formed with a recess for fitting the cutting edge securing portion 23*b*.

At the connecting portion 23*y* and the cutting edge securing portion 23*b*, locking claws 31 are formed at one part, and latching edges 32 are formed at another part.

In regard to the locking claws 31 and the latching edges 32, at least one of them is formed with such as an elastically formable member. In FIG. 5C, the latching edge 32 is elastic while in FIGS. 10A and 10B, the locking claw 32 is elastic. Latching means are composed with the locking claws 31 and the latching edges 32.

Illustrated is such cases that the latching edges 32 are formed in the connecting portion 23*y*, while the locking claws 31 are formed in the exchanging portion (cutting edge fixing portion) 23*b*, and it is sufficient that the locking claws 31 are formed in the connecting portion 23*y*, while the latching edges 32 are formed in the cutting edge fixing portion 23*b*.

[Attachment Member]

Explanation will be made to an attachment member 35 that the cutting edge securing portion 23*b* is attached to the slider part 23*a*, or detached therefrom.

The attachment member 35 is disposed with a connecting means 36 integrating the cutting edge securing portion 23*b*, a cutting edge covering means 37 for covering the first and second cutter blades 21, 22, and an engagement releasing means 38 for releasing the locking and latching means 31, 32

The cutting edge securing portion 23*b* is connected to and disconnected from the slider part 23*a* by means of the attachment member. In particular, for attaching the cutting edge securing portion 23*b* to the slider part 23*a*, the attachment member 35 is connected and attached and after attaching, the attachment member 35 is released and the cutting edge securing 23*b* is fixed to the slider part 23*a*.

For taking off the cutting edge securing portion 23*b* from the slider part 23*a*, the attachment member 35 is connected (releasing engagement) to release the cutting edge securing portion 23*b* from the slider part 23*a*, and thereafter, treatment (handling) is carried out under a condition of covering the cutting edge of the cutting edge securing portion 23*b*.

In the illustrated connecting means 36, the fitting part 36X(36*y*) holding the second holder member 24 is integrally formed in the attachment 35.

The attachment member 35 is integrally formed with an elastic catching piece 39 for catching the cutting edge securing portion 23*b* when taking off and releasing it from the slider part 23*a*.

The cutting edge covering means 37 covers the cutting edges of the first and second cutter blades 21, 22 supported by the first and second holder members 23, 24.

In short, the attachment member 35 integrally fits the cutting edge securing portion 23*b* with its fitting part (connecting means) 36 and covers it with the covering means 37.

Figure 9C:
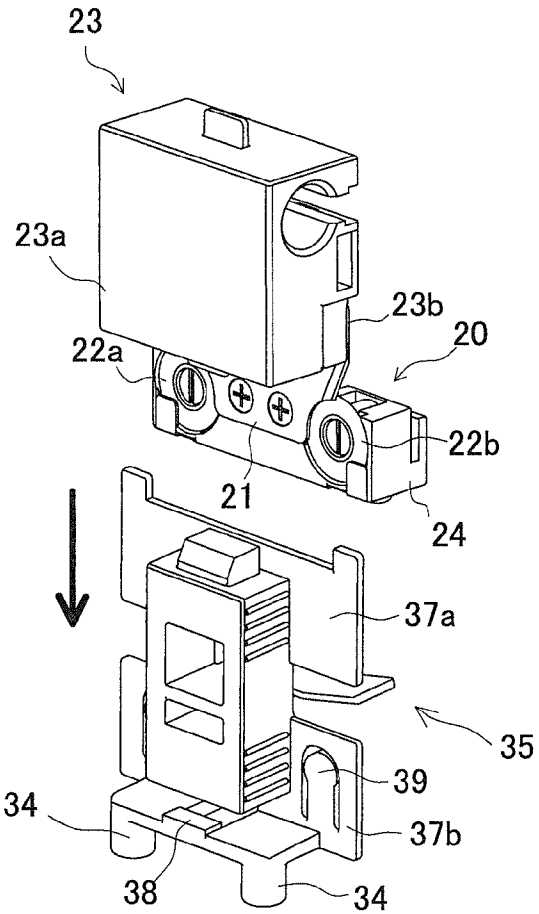
FIGS. 9A, 9B, and 9C are explanatory views of exchanging mechanism of the cutter unit, where 9A shows a new cutter unit to be exchanged and the attaching-detaching attachment, 9B shows a condition of attaching the new cutter unit to the first holder member, and 9C shows a condition of taking off the attachment after having attached a new cutter unit.
Figure 9B:
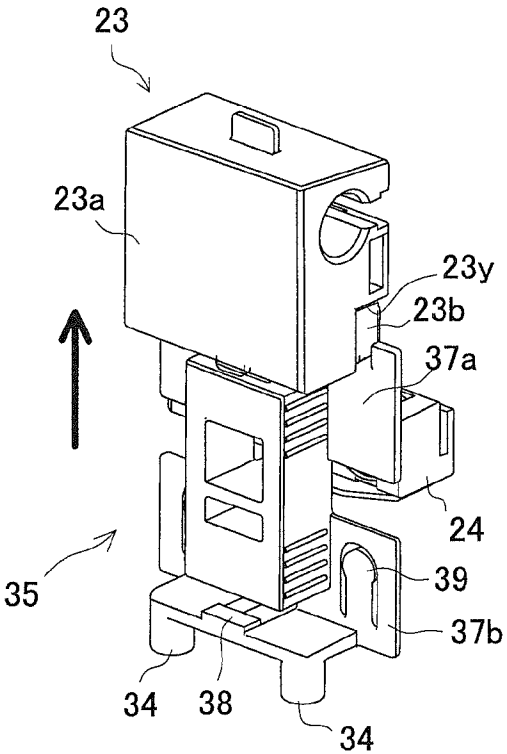
Figure 9A:
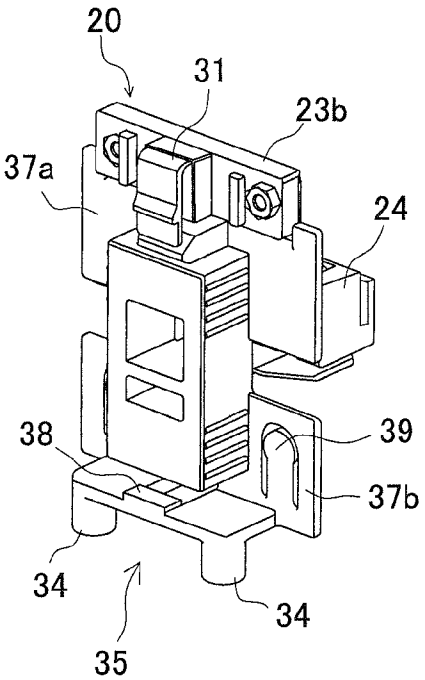
Figure 10A:
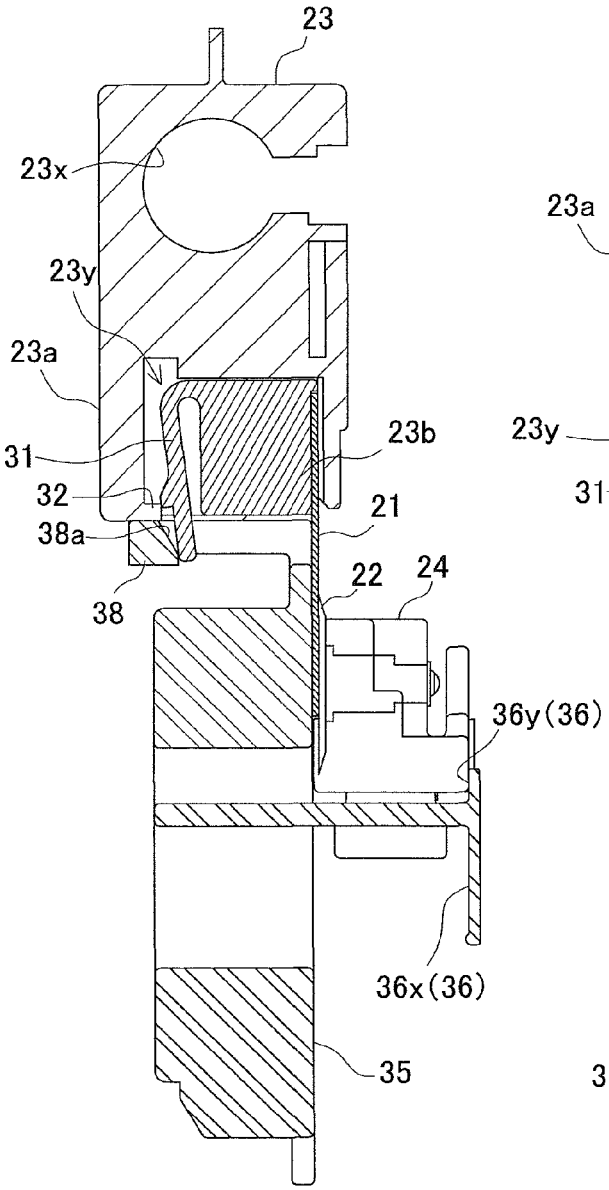
FIGS. 10A and 10B are explanatory views of an exchanging mechanism of the cutter unit, where 10A shows a condition of attaching the cutter unit to a first holder member, and 10B shows a locking condition after having attached.
Figure 10B:
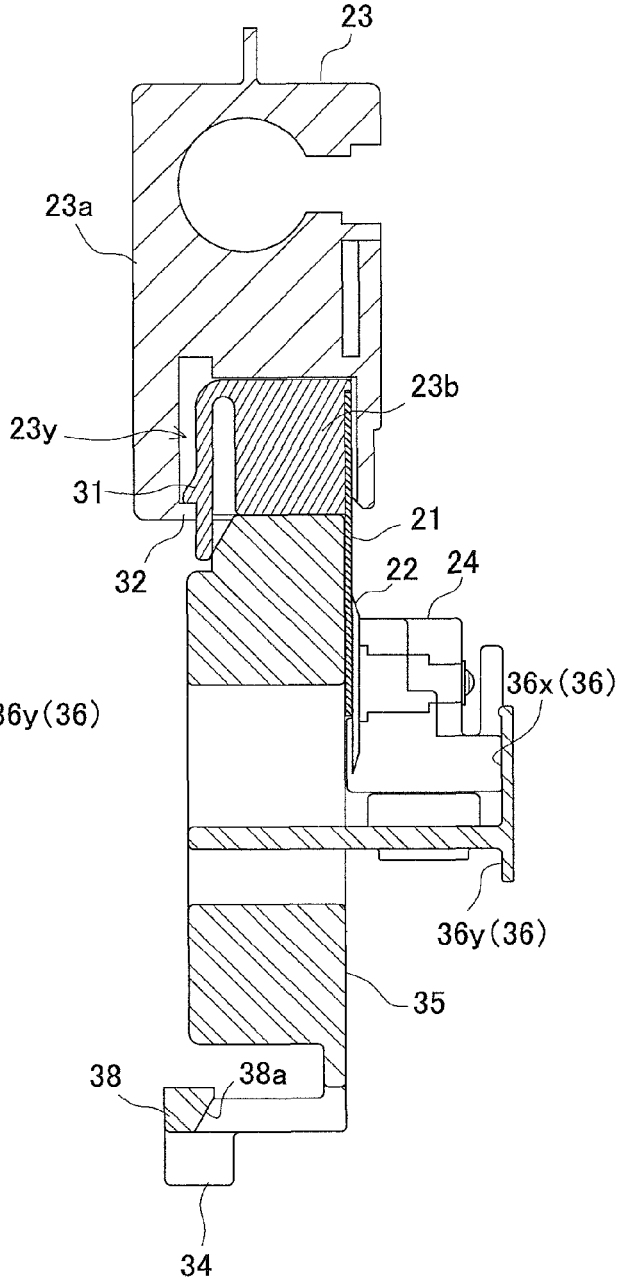

FIG. 9A shows a condition prior to attaching the attachment 35 on the cutting edge securing portion 23*b*, and the cutting edge is exposed as enabling to cut. The same 9B shows a condition of attaching the attachment member 35 on the cutting edge securing portion 23*b*, and the cutting edge securing portion 23*b* is fitted on the fitting portion 36 of the attachment 35, and the cutting edge is covered with the cover part 37.

The illustrated attachment member 35 is structured as enabling to fit on the cutting edge securing portion 23*b* in such a manner of angularly different attitudes depending on the attaching and detaching attitudes.

Figure 8C:
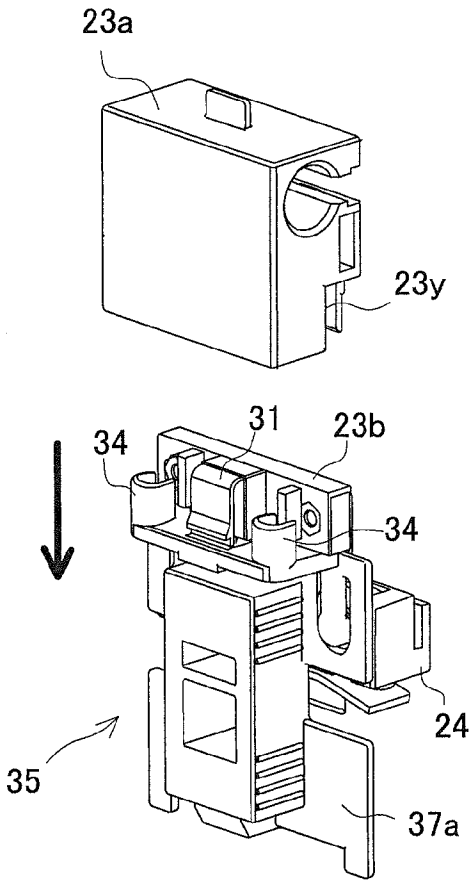
FIGS. 8A, 8B, and 8C are explanatory views of exchanging mechanism of the cutter unit in the apparatus of FIG. 1, where 8A shows a condition of connecting an attaching-detaching attachment for releasing the cutter unit from a first holder member, 8B shows a condition of connecting the attaching-detaching attachment to the cutter unit, and 8C shows a condition of releasing the cutter unit from the first holder member.
Figure 8B:
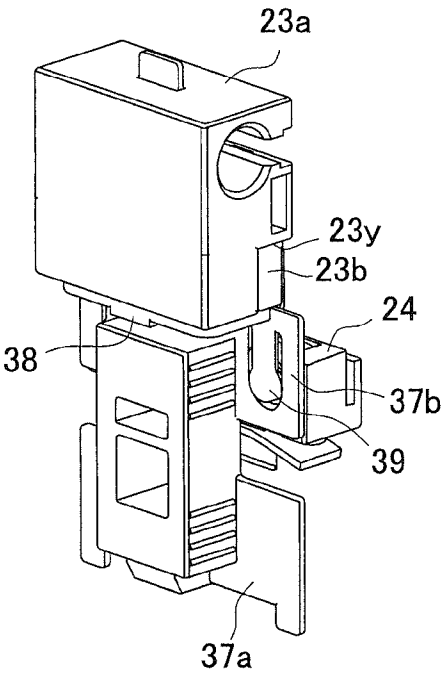
Figure 8A:
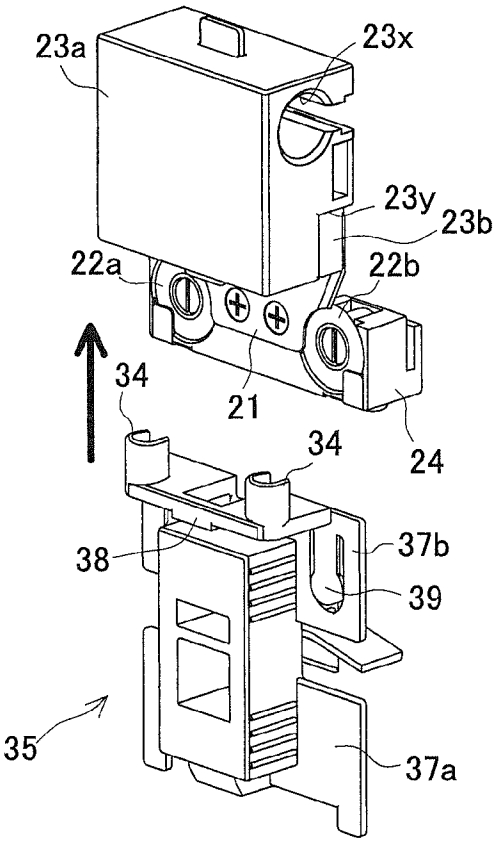

The attaching attitude is a state shown in FIGS. 9A, 9B, and 9C, while the removing attitude is as shown in FIGS. 8A, 8B, and 8C, and both are fitted on the cutting edge securing portion 23*b* at different attitudes 180 degrees. For convenience of the following explanation, the attaching attitude is called as upward, while the detaching attitude is called as downward.

The attachment 35 is disposed with a fitting part (first fitting part) 36*x* fitting the cutting edge securing portion 23*b* in an upward attitude and with a fitting part (second fitting part) 36*y* fitting the cutting edge securing portion 23*b* in a downward attitude, and similarly, there are disposed a cover part (first covering part) 37*a* covering the cutting edge in the upward attitude and a cover part (second covering part) 37*b* covering the cutting edge in the downward attitude.

Further, the attachment 35 is provided with an engagement releasing means 38 of releasing the above mentioned engagement means 31, 32 at the time of the downward attitude (removing attitude). The shown engagement releasing means 38 is formed with a releasing taper face 38*a* (lock releasing face) for engaging and releasing an engaging claw 31 formed in the first holder member 23 with respect to an catching hook 32 (of the side of the attaching side).

The releasing taper face 38*a* is attached to the slider part 23*a*, and this attaching is released under a condition that the engaging claw 31 is geared with the catching hook 32.

[Explanation of moving conditions]

Further explanation will be made to a condition of attaching the cutting edge securing part 23*b* to the slider part 23*a* of the trimmer apparatus A shown in FIGS. 9A, 9B, and 9C.

FIG. 9A shows a condition of uniting the cutting edge securing part 23*b* and the attachment member 35. Under this condition, the cutting edge securing part 23*b* is fitted in a first fitting part 36*x*. This condition is not shown in FIGS. 9A, 9B, and 9C, but shown in a cross sectional view of FIG. 10B.

Under this condition, the cutter blades 21, 22 of the cutting edge securing part 23*b* are covered by a first cover part 37*a* (cover part) and are guarded not to be touched by hands or fingers from an outside.

Accordingly, if packing under a condition where the cutting edge securing part 23*b* shown in FIG. 9A is combined with the attachment member 35 (called as "combined condition" hereafter), the attachment member 35 can be safely dealt with. Next, a user inserts the cutting edge securing part 23*b* under the combined condition into the connect portion 23*y* of the slider part 23*a*.

Then, as shown in FIG. 9B, the cutting edge securing part 23*b* is attached to the slider part 23*a*. At this time, with the engaging means 31 of the first holder member 23, the cutting edge securing part 23*b* is secured to a slider part 23*a*. In short, the engaging claw 31 at the side of the cutter member is geared with an engaging claw 32 (see FIG. 10B) and both are combined.

After the cutting edge securing part 23*b* is attached to the slider part 23*a*, the attachment member 35 is moved down in an arrow direction of FIG. 9C. Then, the attachment member 35 is separated and removed from the cutting edge securing part 23*b*, and the cutting edge securing part 23*b* is secured to the first holder member 23.

In short, the cutting edge securing part 23*b* and the attachment member 35 are made one body owing to holding force of the above mentioned first fitting part 36*x*, and the force of the above mentioned engaging means (the gearing force of the engaging claw 31 and the latching edges 32) is determined to be larger than the holding force (the fitting and friction force).

Accordingly, if forcibly separating the attachment member 35 from the cutting edge securing part 23*b* engaged to the slider part 23*a*, only the attachment member is separated and taken away.

In accordance with FIGS. 8A, 8B, and 8C, further explanation will be made to action of removing the cutting edge securing part 23*b* attached to the slider part 23*a*. FIG. 8A shows a condition of inserting the attachment member 35 into the cutting edge securing part 23*b* under the attached condition in an arrow direction.

At this time, the fitting rod 34 (guide means) of the attachment member 35 is fitted in the fitting hole (guide means) in the side of the slider part 23*a*, and guides movement of the attachment 35.

Therefore, if inserting the attachment member 35 along the guide means (shown are the fitting hole and the fitting rod 34), the attachment member 35 is united with the cutting edge securing part 23*b* as the condition of FIG. 8B. Then, the engaging claw 31 is released from the engagement from the latching edge 32 under the condition FIG. 10A. Thereby, the cutting edge securing part 23*b* is separated from the slider part 23*a*.

If moving the attachment member 35 in the arrow direction under the condition of FIG. 8C, the cutting edge securing part 23*b* is removed from the slider 23*a* together with the attachment member 35. At this time, the second cover part 37*b* of the attachment member 35 covers and guards the cutter blades 21, 22.

[Structures of Image Forming Apparatus and Post-Treatment Apparatus]

Figure 11:
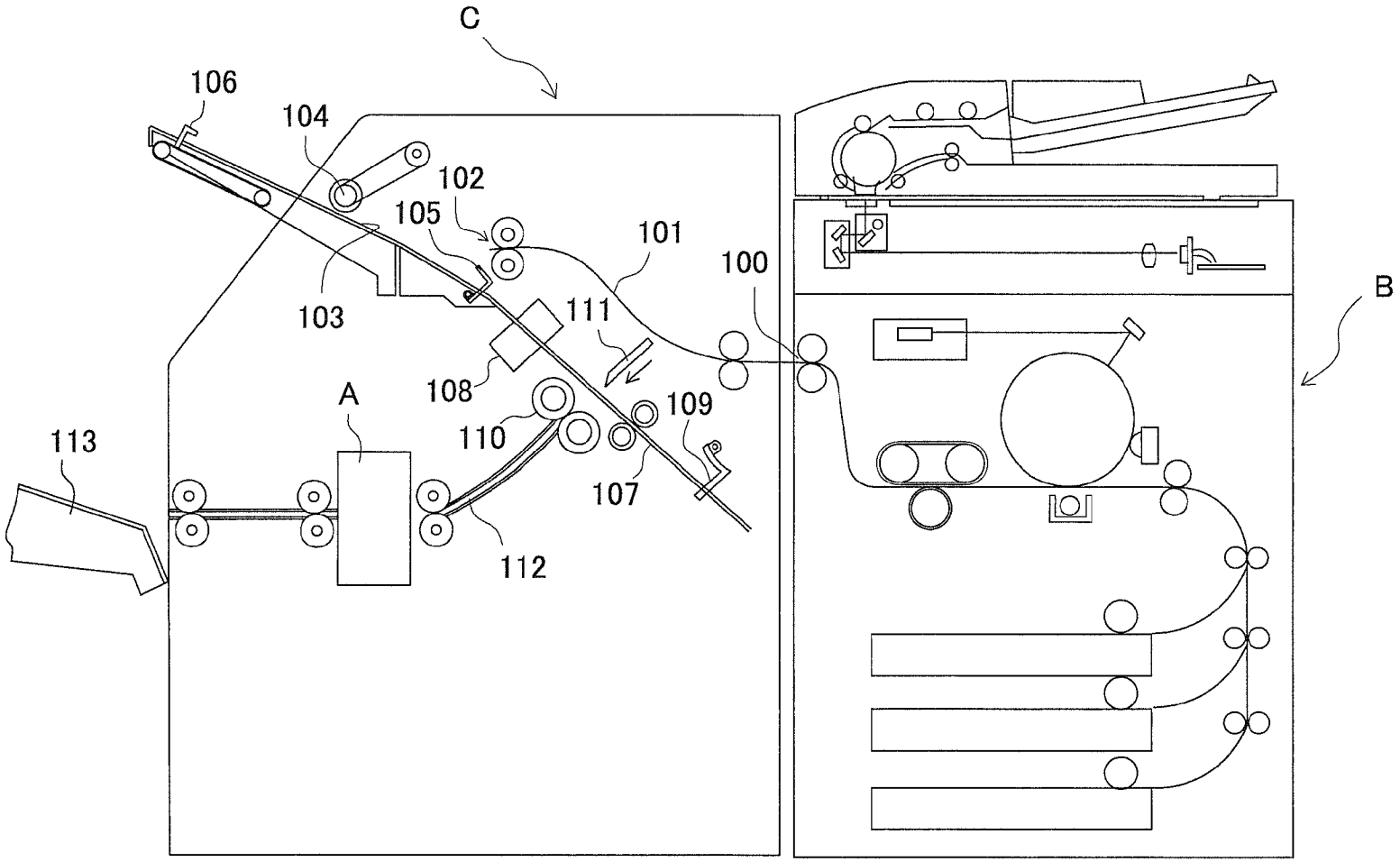
FIG. 11 is an explanatory view of the whole structure of a post-treating apparatus in the present invention.

At the downstream side of an image forming apparatus B shown in FIG. 11, a post-treatment C is connected, and image-formed sheets are performed with the set justification in bundle, and the bundle performed sheets are bound with staples, adhesive tapes and pastes and treated with bookbinding.

The sheet bundle after bookbinding is passed through a cutting regularity of the above mentioned trimmer apparatus A and housed into a waste paper stacker.

Then, an inlet path 101 is provided, communicating with a sheet outlet 100 of the image forming apparatus B, and an accumulating tray 103 is placed at the downstream side of a sheet outlet 102 of this inlet path 101. This tray 103 is provided with a switch back roller 104 sending the sheet before and behind in the sheet outlet direction and a rear end-regulating member 105 regulating the rearward end of the sheet.

The above switch back roller 104 carries the sheet from the outlet 102 to the tray front end side, and after the sheet rear end advances on the tray, the switch back roller 104 moves the sheet in a direction opposite to the sheet outlet, and knocks the regulating member 105 with its rear end, and positioned.

The above accumulating tray 103 is furnished with a rear end pushing member 106 for discharging the accumulated sheet bundle to the downstream side. By the way, the accumulating tray 103 is furnished with a side adjusting member (not shown) for positioning and adjusting an orthogonal direction with sending the sheet advancing from the sheet discharging outlet 102.

Therefore, the sheet discharged from the sheet outlet 102 is conveyed on the tray, and accumulated into a bundle shape under a condition being regulated by the regulating member 105. After then, the sheet bundle is conveyed to the downstream by the rear end pushing member 106 under a condition where the rear end regulating member 105.

At the downstream of the above accumulating tray 103, a bookbinding route 107 is continued, and in this route, a center binding stapler 108 is disposed. Further, the bookbinding route 107 is furnished with a stopper 109 for engaging a front end of the sheet bundle.

Therefore, the sheet bundle accumulated on the tray 103 is moved to the bookbinding route 107 by a rear end pushing member 106, and its front end is bound by the stapler under a condition of being engaged by the stapler.

As having stated above, the center-bound sheet bundle is caught by the stopper 109. Under this condition, as if bending the sheet bind at its center part (staple binding position), a bending roll 110 and a center bending knife 111 are arranged. This bending roll 110 is composed with a pair of rolls, bends the sheet bundle at its center, and moves it to a sheet discharging path 112 at the downstream side.

By the way, the post-treating apparatus C has been shown in the case of bookbinding with stapler, and it is of course sufficient that the sheet accumulated in bundle is coated at its ends with an adhesive agent and wrapped with a cover sheet, otherwise such a bookbinding is made by a top-paste binding, not binding with the surface cover sheet.

As shown in FIG. 11, the trimmer apparatus A built in the housing of the post-processing apparatus C is furnished in the path (paper discharging path) 112 of discharging the bent sheet bundle from the upstream side to the downstream side. In the shown apparatus, the trimmer apparatus A is, as a unit, incorporated in the path (sheet discharging path) 112 of sending the sheet bundle from the bending roll 110 into a stuck tray 113.

What is claimed is:

1. A trimming apparatus comprising:

an apparatus frame, a bed plate having a bed surface for supporting the material to be cut, a first and a second guide member disposed in parallel, and above and under the bed plate, a first holder member slidably supported by the first guide member, and holding a first cutter blade, a second holder member slidably supported by the second guide member, and holding a second cutter blade, a connector connecting the second holder member to the first cutter blade, and a drive assembly slidably connected to the first holder member and driving the first holder member across a width of the material to be cut, wherein the first cutter blade has a first straight inclined cutting edge and the second cutter blade is a circular arc shape blade having a circular arc shape cutting edge, and wherein the first straight inclined edge of the first cutter blade and the circular arc shape cutting edge of the second cutter blade form cutting edges continuing in a direction of thickness of the material to be cut.

2. The trimming apparatus as described in claim 1, wherein the first cutter blade is a flat blade and the circular arc shape blade of the second cutter blade is a rotating blade.

3. The trimming apparatus as described in claim 2, wherein the circular arc shape blade of the second cutter blade rotates owing to friction force acting between the cutter blade and a face to be cut of the material.

4. The trimming apparatus as described in claim 1, wherein the first cutter blade further comprises a second straight inclined cutting edge, wherein the first and second straight inclined cutting edges of the first cutter blade are arranged at opposite ends thereof for cutting the material to be cut in opposite directions, and are inclined in opposite directions with respect to a vertical axis of the first cutter blade, wherein the second cutter blade further comprises another circular arc shape blade having a circular arc shape cutting edge, and wherein the second straight inclined cutting edge of the first cutter blade and the circular arc shape cutting edge of said another circular arc shape blade of the second cutter blade form cutting edges continuing in the direction of thickness of the material to be cut.

5. The trimming apparatus as described in claim 1, wherein the drive assembly is a linear running mechanism for reciprocating from one end of the material to be cut to the other end thereof, and a drive motor.

6. The trimming apparatus as described in claim 5, wherein the linear running mechanism is a belt and pulley mechanism.

7. A trimming apparatus comprising:

an apparatus frame, a bed plate having a bed surface for supporting the material to be cut, a first and second guide member disposed in parallel, and above and under the bed plate, a first holder member slidably supported by the first guide member, and holding a first cutter blade, a second holder member slidably supported by the second guide member, and holding a second cutter blade, a connector which connects the first cutter blade to the second holder member, and a manually operable knob provided on the first holder member for manually reciprocating the first holder member along the first guide member, wherein the first cutter blade has two opposite first and second straight inclined cutting edges, and the second cutter blade has first and second circular blades, each circular blade having a circular cutting edge, wherein the first straight inclined cutting edge of the first cutter blade and the circular cutting edge of the first circular blade form cutting edges continuing in a direction of thickness of the material to be cut, wherein the second straight inclined cutting edge of the first cutter blade and the circular cutting edge of the second circular blade form cutting edges continuing in a direction of thickness of the material to be cut.

* * * * *